US005142895A

United States Patent [19]

Schuchert

[11] Patent Number: 5,142,895

[45] Date of Patent: Sep. 1, 1992

[54] METHOD FOR BENDING TUBES

[75] Inventor: Eugene H. Schuchert, Iowa City, Iowa

[73] Assignee: Amana Refrigeration, Inc., Amana, Iowa

[21] Appl. No.: 351,991

[22] Filed: May 15, 1989

[51] Int. Cl.[5] ..... B21D 11/06; B21D 7/04; B21D 9/04

[52] U.S. Cl. ..... 72/150; 72/149; 72/369; 72/370

[58] Field of Search ..... 72/149, 150, 157, 159, 72/369, 151, 152, 153-156, 158; 29/890.144, 890.149, 890; 138/121

[56] References Cited

U.S. PATENT DOCUMENTS

| | | | |
|---|---|---|---|
| 1,958,447 | 5/1934 | Quartz et al. | 29/890.149 |
| 2,012,766 | 8/1935 | Meyer | 138/121 |
| 2,126,235 | 8/1938 | Wesley | 72/150 |
| 2,223,015 | 11/1940 | Hathorn | 72/150 |
| 2,310,091 | 2/1943 | Kepler | 72/172 |
| 2,357,873 | 9/1944 | Bower | 72/701 |
| 2,406,838 | 9/1946 | Kepler | 72/369 |
| 3,408,844 | 11/1968 | Strachauer et al. | 72/150 |
| 3,456,482 | 7/1969 | Maier et al. | 72/150 |
| 3,472,056 | 10/1969 | Gregg | 72/369 |
| 4,009,601 | 3/1977 | Shimizu | 72/369 |

FOREIGN PATENT DOCUMENTS

| | | | |
|---|---|---|---|
| 666681 | 11/1938 | Fed. Rep. of Germany | 138/121 |
| 852629 | 10/1952 | Fed. Rep. of Germany | 138/121 |
| 3537382 | 3/1977 | Fed. Rep. of Germany | 72/149 |
| 578679 | 10/1924 | France | 138/121 |
| 40-6746 | 3/1965 | Japan | 72/369 |
| 61-222634 | 10/1986 | Japan | 72/369 |
| 16820 | 1/1987 | Japan | 72/149 |
| 271815 | 7/1927 | United Kingdom | 72/150 |
| 347415 | 4/1931 | United Kingdom | 72/154 |

OTHER PUBLICATIONS

U.K. Patent Application No. GB 2,205,260 A, Pub. Dec. 7, 1988.

DL 50,195 published Oct. 1966; East Germany; 8 sheet drwg & 4 pp. of spec.

*Primary Examiner*—John Sipos
*Assistant Examiner*—Donald M. Gurley
*Attorney, Agent, or Firm*—William R. Clark; Richard M. Sharkansky

[57] ABSTRACT

The method of bending relatively thin wall tubing to form a tubular heat exchanger that has relatively tight bends with controlled wrinkles. For example, 1.75-inch outer diameter stainless steel tube may have a wall thickness of 0.035 inches and be bent using a controlled-wrinkle bend die to a 180° bend having a centerline radius of 2.5 inches.

12 Claims, 4 Drawing Sheets

METHOD FOR BENDING TUBES

BACKGROUND OF THE INVENTION

The field of the invention generally relates to a method for bending tubes, and more particularly relates to bending tubes to form tubular heat exchangers for residential furnaces.

Recently, residential furnaces have been constructed using tubular heat exchangers instead of the more conventional clam-shell heat exchangers. With such arrangement, a plurality of stainless steel or aluminized steel tubes are provided, and one end of each is fired by an individual burner orifice. The combustion gases heat the tubes, and the heat is transferred to household return air that is passed across the tubes within a heat exchange chamber of the furnace. In one furnace embodiment, the combustion gases are then exhausted; in an alternate furnace embodiment, the combustion gases are then directed from the tubes to a recuperative heat exchanger so as to increase the efficiency of the furnace.

In the above-described furnace application, it is desirable to maximize the heat exchange surface area within the confined or restricted volume inside the heat exchange chamber. Accordingly, each tube is bent into a serpentine configuration so as to increase the length of each tube that will fit into the chamber. Typically, the tubes have a 1.75-inch outer diameter (OD) and a wall thickness (WT) of 0.035 inches. Each of the bends is 180° and has a relatively tight centerline radius (CLR) such as, for example, 2.5 inches. The bends are made using a conventional rotary bend die with a linked-ball mandrel. More specifically, a tube is seated in the groove of the rotary bend die that has a wiper die positioned adjacent thereto. Conventionally, the wiper die has a corresponding tangential groove with a knife edge that conforms to the bend die groove so as to prevent wrinkling of the tube at the tangent point. Next, a pressure die and clamp die are moved up against the opposite side of the tube with the pressure die pressing the pipe against the wiper die and the clamp die clamping a front portion of the tube to the bend die. The bend die and clamp die are then rotated approximately 180° while the pressure die moves forward linearly carrying the tube tangentially to the bend point. In conventional manner, a ball mandrel is positioned inside the tube during the bending process, and it advances with the tube around the bend so as to prevent the tube from collapsing. Next, the ball mandrel, the pressure die and the clamp die are retracted, and the tube is removed from the bend die by applying a relatively small removal force. In one furnace configuration, each tube is bent in three locations thus providing four parallel segments. In an alternate configuration, each tube is bent in five locations thus providing six parallel segments. Each tube is also rotated on its axis in altering directions after each bend so as to limit the vertical height of the tubular heat exchanger; this also provides for more dense packing of the segments of the tube within the heat exchange chamber.

The above-described method of bending tubes or pipes has a number of disadvantages. First, the wiper dies and the ball mandrels wear out or break at a relatively fast rate and are expensive to replace. Second, lubrication is conventionally applied so as to reduce the wear on the ball mandrels and on the knive edge of the wiper die. After the tubes have been bent, the lubrication has to be cleaned from the tubular heat exchangers, and this involves additional labor. Further, there are problems and costs associated with disposing of the used lubrication. Third, the rejection rate - i.e. the percentage of tubular heat exchangers that fail to pass inspection - is relatively high with the above-described method of bending. One factor that contributes to the high rejection rate is that the above-described internal multi-ball mandrel bending technique may cause excessive thinning of the outer wall of the tube. More specifically, such technique normally causes the neutral axis—the transition point between compression on the inside of the bend and tension on the outside of the bend—to be located toward the inside of the bend or typically about a third of the way from inside to outside. As a result, a tube with a wall thickness of 0.035 inches may typically be thinned to approximately 0.028 inches on the outside, and this puts relatively high stress on the tubing and particularly its weld seam. Another factor that contributes to the high rejection rate is that as the multi-ball mandrel is extracted from the bent tube, it wears against the ridges on the inside of the bend and smoothes them down or bends them over.

For some industry applications, tubes have been bent without the use of a mandrel. Also, controlled-wrinkle compression bend dies have been used. However, bending without the use of a mandrel is generally reserved for bends that are less than 180° and with tubing that has relatively thick walls. More specifically, as a general rule, it is thought that the Bending Factor of such bends should not exceed 12, and generally should be in the range 4–7. Here, Bending Factor is defined as $$\text{Bending Factor} = \text{Wall Factor} \div (\text{CLR} \div \text{OD})$$

where Wall Factor is the outer diameter of the tube divided by the wall thickness, CLR is the centerline radius of the bend, and OD is the outer diameter of the tube. However, 12 is much too low a Bending Factor for the tube and bending parameters which are most advantageous for a residential furnace application. For example, to attain a Bending Factor of 12 for a 2.5-inch CLR bend using 1.75-inch OD tube, the wall thickness would have to be increased to approximately 0.1 inches, but this tube would not be cost effective to use. Alternatively, to attain a bending factor of 12 using a 1.75-inch OD tube with a wall thickness of 0.035 inches, the centerline radius would have to be increased to approximately 7.3 inches; this bend, however, would not be tight enough to optimize the heat exchange surface area within the heat exchange chamber.

SUMMARY OF THE INVENTION

It is an object of the invention to provide an improved method of bending a tube to form a tubular heat exchanger for a residential furnace.

It is a further object to provide an improved method of bending a thin wall tube in relatively tight 180° bends without the use of a wiper die or an internal ball mandrel. For example, such a tube may have a 1.75-inch outer diameter with a 0.035-inch wall thickness, and the centerline radius may be 2.5 inches. It is also an object to eliminate the lubrication that is typically used to reduce wear on wiper dies and internal ball mandrels.

It is a further object to provide an improved method of dry bending thin wall tubes so that there are relatively few rejects.

It is also an object to provide a thin wall tubular heat exchanger that has bends with controlled wrinkles and relatively high collapse. It is a further object to provide restrictions in the tubular heat exchanger so as to limit the rate at which combustion gases flow therethrough.

In accordance with the invention, the method of bending a tube comprises the steps of providing a tube having an outer diameter of 2.5 inches or less with a wall thickness of 0.05 inches or less, providing a bend die having a controlled-wrinkle tube groove with a centerline radius of 3.5 inches or less, providing a pressure die and a clamp die, seating the tube tangentially in the tube groove of the bend die, clamping the tube to the bend die with the clamp die, and moving the tube tangentially toward the bend die with the pressure die while rotating the bend die and the clamp die approximately 180° to form a bend of approximately 180° with controlled wrinkles on the inside of the bend. Preferably, the tube may be stainless steel and have an outer diameter of approximately 1.75 inches with a wall thickness of approximately 0.035 inches. Preferably, a stationary plastic plug mandrel may be inserted inside the tube during bending so as to limit or control the collapse of the tube. The controlled-wrinkle tube groove may preferably comprise elongated indentations or serrations that span an arc greater than 180° so as to provide controlled wrinkles beyond the tangent point of the bend. Also, with such apparatus, it may be preferable to split the bend die and raise the tube out of the lower half of the die after bending so as to remove the tube.

The invention may also be practiced by a tubular heat exchanger for a furnace, comprising a tube having at least one bend of approximately 180°, the tube having a ratio of Wall Factor to D Factor that is greater than 20 with controlled wrinkles on the inside of the bend. Here, Wall Factor is defined as the outer diameter of the tube divided by the wall thickness, and D Factor is defined as the centerline radius of the bend divided by the outer diameter of the tube.

In accordance with the invention, relatively tight bends are provided in a thin wall tube using apparatus and method that were heretofore used for applications permitting the use of thick wall tubing and generous or loose bends. That is, a stainless steel tube having a 1.75-inch outer diameter and 0.035-inch wall thickness have been bent to 180° with a centerline radius of 2.5 inches using a controlled-wrinkle bend die. The use of a moving or advancing multi-ball mandrel has been eliminated, and optionally, a stationary plastic plug mandrel may be used. Also, the wrinkle indentations have been extended in the bend groove beyond the tangent point, and accordingly, the bend die is separated or split to remove the tube. Also, the tube groove may be elliptical so as to enhance the cylindrical strength while bending. With such arrangement, the tubular heat exchangers have relatively high collapse at the bends. However, it has been found that the relatively high collapse is tolerable, if not beneficial, to performance in the particular low flow rate applications of heat exchangers. Furthermore, the wrinkles increase combustion gas turbulence and thereby improve heat transfer.

BRIEF DESCRIPTION OF THE DRAWINGS

The foregoing objects and advantages of the invention will be more fully understood by reading the Description of the Preferred Embodiment with reference to the drawings wherein.

DESCRIPTION OF THE PREFERRED EMBODIMENT

Figure 1:
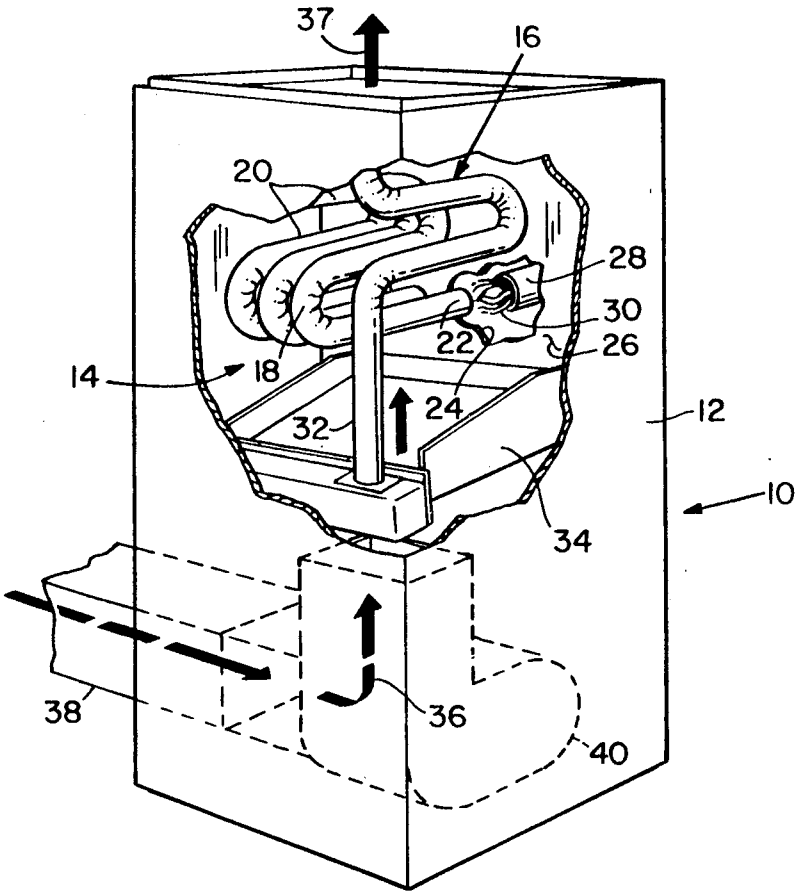
FIG. 1 is a partially broken away perspective view of a residential furnace embodying tubular heat exchangers in accordance with the invention.

Referring to FIG. 1, residential furnace 10 has an upright generally rectangular outer casing 12 in which heat exchange chamber 14 or duct is located. A plurality of tubular heat exchangers 16 are positioned in heat exchange chamber 14, and each tubular heat exchanger 16 has at least one relatively tight bend 18 so as to increase the length of each tubular heat exchanger 16 that fits into the limited or confined volume of chamber 14. More specifically, it is desirable to maximize the heat exchange surface area or length of each tubular heat exchanger 16 within chamber 14, and for this purpose, each tubular heat exchanger 16 here has three relatively tight 180° bends 18 thereby forming a serpentine structure having four parallel segments 20. Tubular heat exchangers 16 are closely spaced in side-by-side arrangement and preferably the segments 20 are vertically staggered so as to optimize thermal transfer to the air being heated. One end 22 of each tubular heat exchanger 16 communicates through an aperture 24 in wall 26 of chamber 14, and an individual burner head 28 or orifice is fired into each tubular heat exchanger 16. The combustion gases 30 pass upwardly in the respective tubular heat exchangers 16 to a manifold (not shown) at the top of furnace 10. The combustion gases 30 are then transferred from the manifold via tubes 32 to recuperative heat exchanger 34 from which the combustion or flue gases are exhausted from the house.

Return air 36 is drawn from the house through return air duct 38 by fan 40, and then directed upwardly through recuperative heat exchanger 34 and heat exchange chamber 14. That is, the return air 36 is first heated by the recuperative heat exchanger 34 which is the last stage for extracting heat from the combustion gases 30. As is well known, the combustion gases 30 are cooled below their dew point in the recuperative heat exchanger 34 thereby resulting in condensate that is drained from furnace 10. After being preheated in the recuperative heat exchanger 34, the return air 36 is then directed up through the respective segments 20 of the tubular heat exchangers 16 that are arranged so as to optimize the heat transfer from the combustion gases 30 in the tubular heat exchangers 16 to the return air 36. The supply air 37 is then recirculated back to the house.

Although furnace 10 is here shown and described as an upward flow recuperative furnace, tubular heat exchangers 16 could be used to advantage in other types of furnaces. For example, the furnace could be a lower efficiency noncondensing furnace in which case recuperative heat exchanger 34 would be eliminated and the combustion or flue gases 30 would be exhausted directly from the tubular heat exchangers 16. Also, the general configuration could be a counter-flow furnace wherein the return air 36 would be directed downwardly in which case the heat exchangers 16 and 34 would have a different arrangement. Further, tubular heat exchangers 16 could be used in a horizontal-flow furnace.

Figure 2:
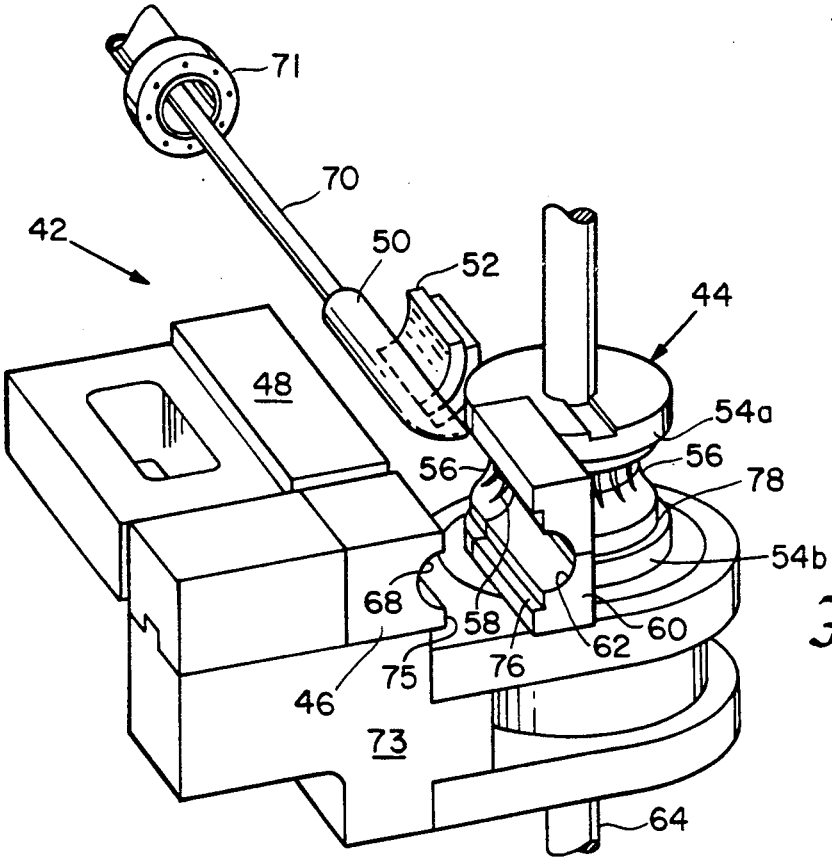
FIG. 2 is tooling used to bend the tubular heat exchangers.
Figure 4:
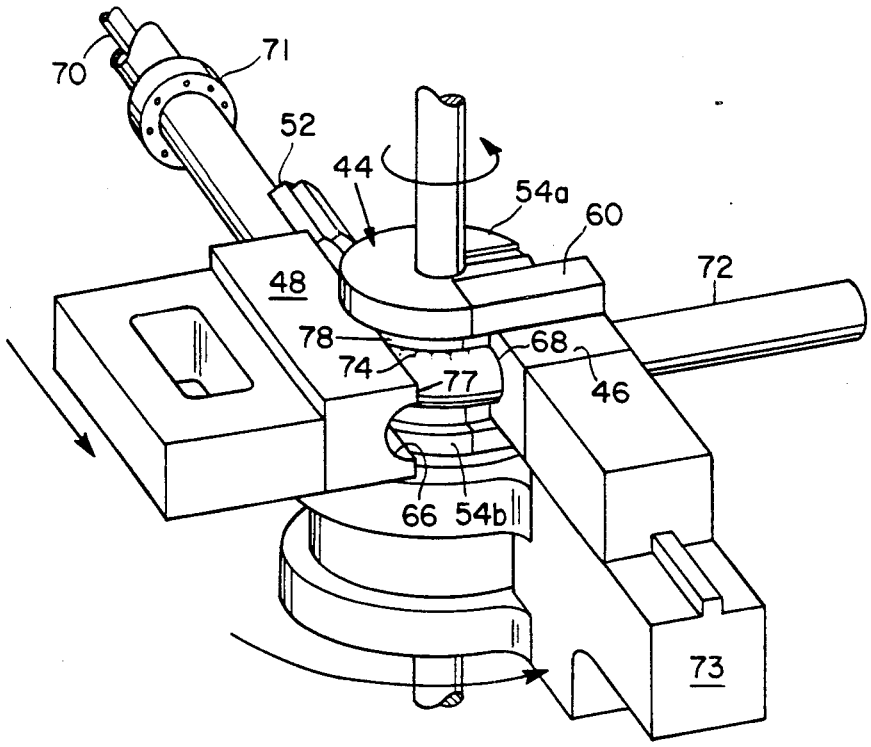
FIG. 4 is the second step after the bend die and clamp die have been rotated 90°, and the pressure die has moved part way forward.
Figure 5:
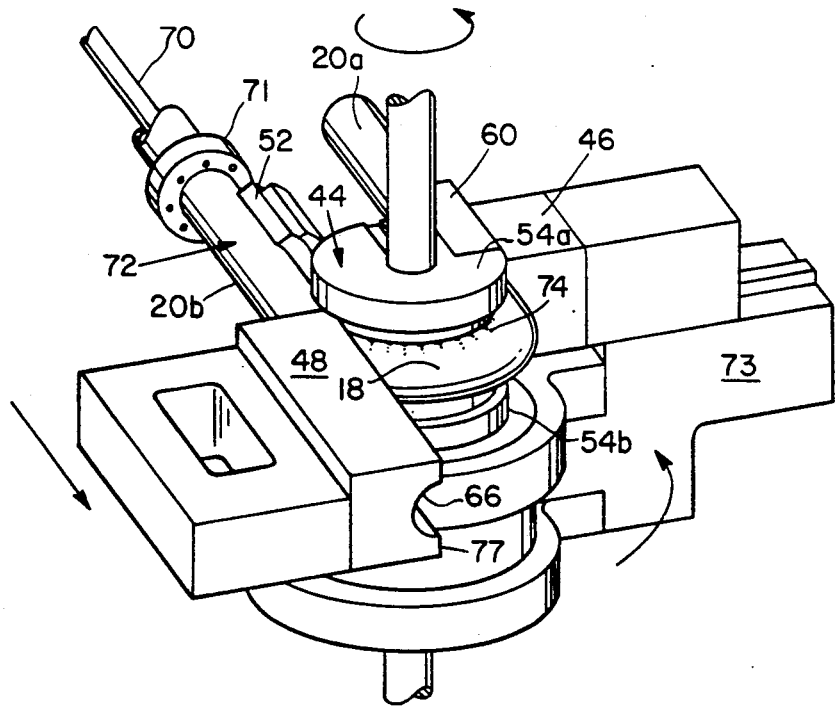
FIG. 5 is the third step after the bend die and clamp die have rotated 180°, and the pressure die has moved further forward.
Figure 6:
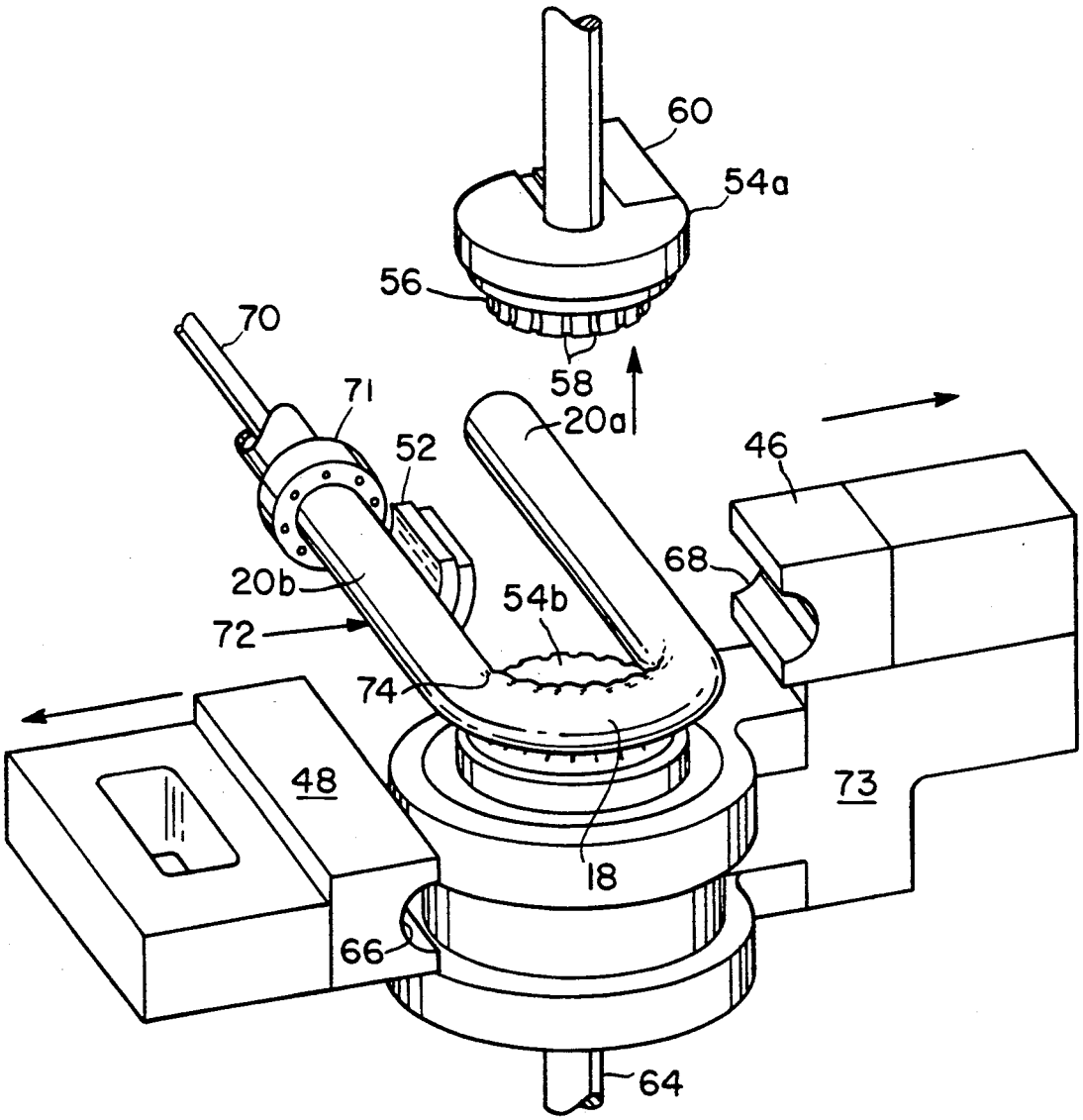
FIG. 6 is the last step of the bending which includes splitting the bend die to remove the tube.

In accordance with the invention, FIGS. 2-6 illustrate sequential steps in the process of making or forming a tubular heat exchanger 16 from straight stainless steel or aluminized steel tube here having an outer diameter OD of 1.75 inches and a wall thickness WT of 0.035 inches FIG. 2 shows the tube bend tooling 42 that includes bend die 44, clamp die 46, pressure die 48, plastic plug mandrel 50, and plastic follower 52. Bend die 44 is a split die having symmetrical upper and lower sections 54*a* and *b* which, as shown in FIG. 6, can be vertically separated at a midportion. When sections 54*a* and *b* are engaged or fitted together, they form a generally circular or cylindrical block having a horizontal tube groove 56 that has generally elliptical curvature and is adapted for receiving a tube 72 or pipe having a 1.75 OD. Tube groove 56 has a plurality of vertical elongated controlled-wrinkle indentations 58 or serrations that are disposed in an arc greater than 180°. That is, the serrations 58 extend beyond the tangents of the bend arc or bend portion of bend die 44. The centerline radius CLR of the bend die is here approximately 2.5 inches. That is, the distance from the center or rotational axis of bend die 44 to the entrance of tube groove 56 is such that tube bent with bend die 44 has a centerline radius of approximately 2.5 inches. Grip section 60 also has a tube groove 62 conforming to groove 56 except that it is linear and extends tangentially from tube groove 56. As is conventional, bend die 44 is mounted to a rotary drive 64 such that bend die 44 can be rotated during bending.

Pressure die 48 and clamp die 46 have respective linear tube grooves 66 and 68 that may preferably be elliptically shaped and adapted for receiving a tube which here has a 1.75 inch OD. Initially, pressure die 48 and clamp die 46 are aligned side-by-side with tube grooves 66 and 68 linearly aligned, and they are spaced from the axis defined by tube groove 56 and grip section 60. A plastic follower 52 having an arcuate surface generally conforming to the outer diameter of the tube being bent is mounted behind the bend die 44 diametrically opposite pressure die 48. A mandrel rod 70 with a plastic plug mandrel 50 on the end extends forwardly with bend die 44 and plastic follower 52 on one side, and pressure die 48 and clamp die 46 on the opposite side. Supporting and drive mechanisms for bend die 44, pressure die 48, clamp die 46, mandrel rod 70, and plastic follower 52 are not described in detail herein because they are conventional, and an explanation of them is not necessary for understanding the invention.

Figure 3:
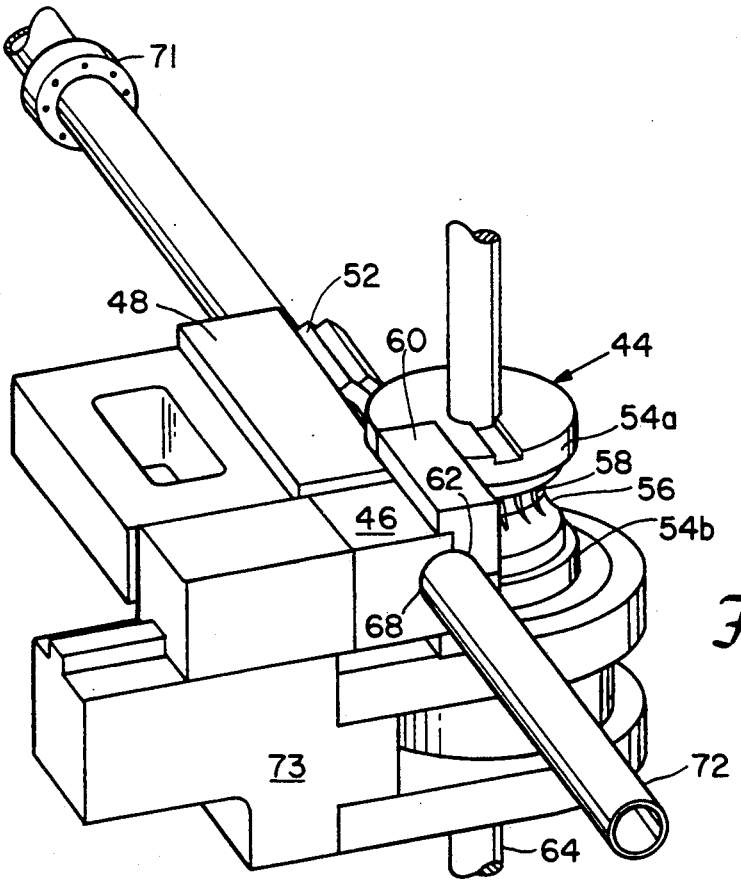
FIG. 3 is the first step in readying a tube in the tooling for bending.

Referring to FIG. 3, tube 72 is positioned on mandrel rod 70 and is held in place by collet 71. Pressure die 48 and clamp die 46 are then moved laterally so as to engage tube 72. More specifically, clamp die 46 is moved diametrically opposite grip section 60 such that the face edges 75 of clamp die 46 respectively seat in conforming grip section notches 76 that are adjacent tube groove 62. Accordingly, clamp die 46 and grip section 60 are interlocked, and tube 72 is firmly clamped therebetween. Similarly, the portion of tube 72 immediately behind clamp die 46 is received in tube groove 66 of pressure die 48. Lateral pressure exerted on tube 72 by pressure die 48 is restrained by plastic follower 52. Also, a portion of face edges 77 (FIG. 4) of pressure die 48 seat in and interlock with conforming notches 78 of bend die 44.

Referring to FIG. 4, bend die 44 and clamp die 46 are rotated in unison while pressure die 48 drives linearly forward with portions of face edges 77 continuously being seated in notches 78. Tube 72, which remains held by collet 71, is driven forwardly to the tangent or bend point of bend die 44. Plastic follower 52 has a relatively low coefficient of friction such that tube 72 readily slides over it while plastic follower 52 continues to restrain the pressure of pressure die 48. During the bending process, tube 72 continues to be clamped between clamp die 46 and grip section 60 as clamp die 46 is driven by a suitable rotating arm 73. As tube 72 bends around rotating bend die 44, the inside of the tube bend is compressed and the metal flows into the elongated vertical serrations 58 thereby forming controlled wrinkles 74.

Referring to FIG. 5, tube 72 is shown after it has been bent a full 180° such that segments 20*a* and *b* are parallel. In such state, bend die 44 has rotated 180° from its initial orientation, and likewise clamp die 46 has been rotated 180° about the central axis of bend die 44 such that tube groove 68 now faces in the opposite direction from its initial position, and still clamps the tube 72 to grip section 60 of bend die 44. Also, pressure die 48 is shown to have linearly traversed to its forwardmost position where it still engages tube 72 at its tangency point to bend die 44. During the entire bending process, plastic plug mandrel 50 remains in a stationary position within tube 72, and thereby functions to limit or control the collapse of pipe 72. More specifically, plastic plug mandrel 50 does not advance around the bend as a multiball mandrel would, but rather remains stationary with its tip being in approximate region of the tangent or bend point. Plastic plug mandrel 50 is subject to wear that particularly occurs on the outside as the wall of pipe 72 slides against it, but plastic plug mandrels 50 are relatively inexpensive to replace. As the plastic wears, the plastic plug mandrel 50 is moved slightly forward by a simple machine adjustment so that the tip remains properly positioned to control collapse to the desired degree. In an alternate embodiment, tubes 72 may be bent without using a plastic plug mandrel or any other internal supporting structure. In other words, tubes 72 can be bent as shown in FIGS. 2-6 without any collapse suppressing structure on the inside.

Referring to FIG. 6, pressure die 48 and clamp die 46 are moved in respective directions away from bend die 44 so as to release tube 72. Also, upper section 54*a* of bend die 44 is split or separated from lower section 54*b* using suitable apparatus so that tube 72 can be removed from bend die 44. More specifically, the flow of metal from the inside bends of tube 72 into serrations 58 prevents the removal of tube 72 from bend die 44 without first splitting bend die 44 and raising tube 72 so that tube 72 can be advanced forward for the next sequential rotation and bend. That is, with a relatively large angle bend such as 180° as described here, and especially with the serrations 58 being disposed in an arc greater than 180° so as to provide control wrinkles beyond the inner tangent points, the tube 72 could not be removed horizontally from bend die 44 because the wrinkles 74 near the bend extremities engaged the corresponding serrations 58. Typically, the upper section 54*a* of bend die 44 may be raised approximately $\frac{3}{4}$ inches, and then the tube 72 raised $\frac{3}{8}$ inches to free it. Once the tube 72 is disengaged from bend die 44, sequential bends may be made to tube 72 by repeating the same process. That is, the upper section 54*a* of bend die 44 is reengaged to the lower section 54*b*, and the bend die 44 is rotated clockwise as shown back to the original orientation as shown in FIG. 2. Also, clamp die 46 is rotated back adjacent pressure die 48 and both are moved rearwardly to the starting position as shown in FIG. 2. Then, tube 72 is moved forwardly to a new bend position, and preferably rotated on its axis so that subsequent parallel segments 20 are not linearly disposed with segments 20*a* and b. That is, the tube 72 may rotated in opposite directions from bend-to-bend so that the serpentine segments 20 are vertically staggered so as to provide a desirable low profile arrangement for tubular heat exchanger 16 in chamber 14.

Figure 7:
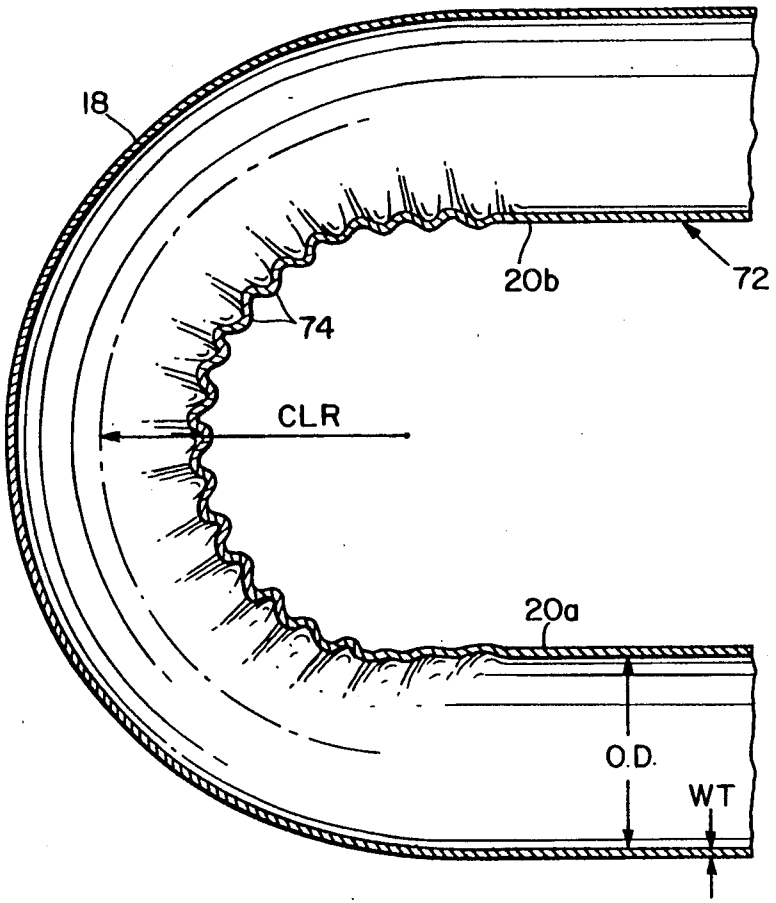
FIG. 7 is a sectioned view of the tube after being bent.

FIG. 7 shows a sectioned view of tube 72 after being bent in accordance with the invention. Here, tube 72 has an outer diameter OD of 1.75 inches with a wall thickness WT of 0.035 inches, and the centerline radius CLR of the controlled wrinkle bend is 2.5 inches. Accordingly, $$\text{Wall Factor} = \text{OD} \div \text{WT} = 50$$

$$\text{D Factor} = \text{CLR} \div \text{OD} = 1.43$$

and $$\text{Bend Factor} = \text{Wall Factor} \div \text{D factor} = 35$$

As shown, there are controlled wrinkles 74 on the inside of the bend, and some of the wrinkles 74 extend beyond a 180° arc; that is, the wrinkles 74 extend beyond the tangent points that provide the bend arc which makes segments 20*a* and *b* parallel with each other.

In accordance with the invention, there is provided an improved method of bending thin wall tubing or pipe, and such method has particular advantage in making tubular heat exchangers 16 for residential furnaces. Through the use of a controlled-wrinkle bending die 44, serrations or indentations 58 provide regions for controlling the flow of compressed metal of the inside wall of the tube 72 whereas, without the indentations 58, there would be uncontrolled wrinkles when bending tube 72 with the above-described parameters (e.g. 0D=1.75, WT=0.035, CLR=2.5, and a 180° bend). Wiper dies and linked-ball mandrels have been eliminated, and these were high wear parts that were expensive to replace. Also, by eliminating the wiper dies and linked ball mandrels, lubrication is no longer required in order to attempt to limit the wear of these parts. Accordingly, the steps of cleaning the lubrication off bent tubes and of then disposing of the lubrication have been eliminated. Further, wear on the pressure die 48 has been reduced because the controlled-wrinkles 74 on the tube 72 assist in pulling the tube 72 around the bend die 44 thereby reducing the required pressure of the pressure die 48.

Tubular heat exchangers 16 bent in accordance with the invention exhibit desirable characteristics. First, the tube wall thickness is relatively thin, such as, for example, 0.05 inches or less and, more preferably, 0.035 inches. Accordingly, the initial cost of the tube 72 is less as compared to thicker wall tubing that is conventionally associated with controlled wrinkle bending. Also, favorable heat transfer characteristics are provided by the thin wall tubing. Second, the outer diameter is relatively small such as, for example, 2.5 inches or less, and more preferably 1.75 inches. The 180° bends are relatively tight such as, for example, having a centerline radius of 3.5 inches or less, and, more preferably, 2.5 inches. As a result, the tubular heat exchangers 16 are configured and arranged in chamber 14 so as to provide relatively large heat exchanger surface areas that effectively transfer heat from the combustion gases 30 to the return air 36. Third, the reject rate of tubular heat exchangers 16 bent in accordance with the invention has greatly improved. One factor contributing to the improvement is that there is less thinning of the outer wall because controlled wrinkle grooves are used. More specifically, the neutral axis is more outward than before because the serrations 58 provide a controlled flow of the metal on the inside thereby reducing the inside compression. As a result, typical thinning may be approximately 0.035 to 0.033 inches, as contrasted with 0.035 to 0.028 without controlled wrinkle serrations 58. Another contributing factor is that by using a stationary plastic plug mandrel as contrasted with an advancing multi-ball metal mandrel that has to be retracted around the bend, there is no longer wear and damage caused by removing the mandrel.

Bending in accordance with the invention without the use of interior tube support structure, or at least without the use of metal support structure such as a multi-ball mandrel, results in relatively high collapse of tube 72. For example, typical collapse in accordance with the invention may be approximately 20% up to 50%. Also, the presence of wrinkles 74 on the inside bend causes additional restriction and turbulence of the combustion gases 30 thereby reducing the flow rate. However, for the particular application of tubular heat exchangers 16 for furnaces, it has been found that the increased collapse and wrinkles 74 actually contribute to improving performance. More specifically, optimum heat exchange occurs for this particular residential furnace application when the combustion gas flow rate is relatively small such as, for example, 5 cubic feet per minute. For this application, the restrictions caused by tube collapse at the bends contributes rather than detracts from this flow rate objective. Also, the wrinkles 74 cause turbulence of the combustion gases 30 thereby improving heat transfer from the combustion gases 30 to the tube wall. Stated differently, in this heat exchanger application where high flow rates are not an objective and, indeed, may be detrimental to performance and efficiency, relatively high tube collapse during bending can be tolerated or even appreciated. In short, relatively high tube collapse and wrinkles 74 help to slow down the combustion gases 30 thereby increasing the heat transfer per volume of combustion gas. Also, there are other applications where greater than normal tube collapse is not detrimental to performance.

This concludes the Description of the Preferred Embodiment. However, a reading of it by one skilled in the art will bring to mind many alterations and modifications that do not depart from the spirit and scope of the invention. Accordingly, it is intended that the scope of the invention be limited only by the appended claims.

What is claimed is:

1. A method of bending a steel tube to form a tubular heat exchanger for a furnace, comprising the steps of:

providing a steel tube having an outer diameter of 2.5 inches or less and a wall thickness of 0.05 inches or less;

providing a bend die having a controlled-wrinkle tube groove comprising elongated indentations spanning an arc greater than 180°, said bend die having a centerline radius of 3.5 inches or less;

providing a pressure die and a clamp die;

seating said tube tangentially in said tube groove of said bend die;

clamping said tube to said bend die with said clamp die; and moving said tube tangentially toward said bend die with said pressure die while rotating said bend die and clamp die approximately 180° to form an approximately 180° bend having controlled-wrinkles on the inside surface of said tube at said bend.

2. The method recited in claim 1 wherein the outer diameter of said tube is approximately 1.75 inches.

3. The method recited in claim 1 wherein said wall thickness of said tube is approximately 0.035 inches.

4. The method recited in claim 1 wherein said tube is stainless steel.

5. The method recited in claim 1 further comprising the step of inserting a stationary plastic plug mandrel into said tube so as to control collapse during bending.

6. The method recited in claim 1 further comprising the step of splitting said bend die to remove said tube after bending it approximately 180°.

7. A method of bending tube to form a tubular heat exchanger for a furnace, comprising the steps of:

providing a stainless steel tube having an outer diameter of approximately 1.75 inches and a wall thickness of approximately 0.035 inches;

providing a split bend die having a controlled-wrinkle compression groove with a plurality of elongated indentations that are orthogonal to the groove, said bend die having a centerline radius less than 3.5 inches;

providing a pressure die and a clamp die;

seating the tube tangentially in said groove of said bend die;

inserting a plastic plug mandrel into said tube;

clamping said tube to said bend die with said clamp die; and moving said tube tangentially toward said bend die with said pressure die while rotating said bend die and clamp die approximately 180° to form an approximately 180° bend having controlled-wrinkles on the inside surface of said tube at said bend.

8. The method recited in claim 7 further comprising the step of splitting said bend die to remove said tube from said bend die after said tube has been bent.

9. The method recited in claim 7 wherein said indentations span an arc greater than 180° in said groove.

10. A method comprising the steps of:

providing a steel tube having an outer diameter of 2.5 inches or less and a wall thickness of 0.05 inches or less;

providing a bend die having a controlled-wrinkle tube groove comprising elongated indentations, said bend die having a centerline radius of 3.5 inches or less;

providing a pressure die and a clamp die;

seating said tube tangentially in said tube groove of said bend die;

clamping said tube to said bend die with said clamp die;

moving said tube tangentially toward said bend die with said pressure die while rotating said bend die and said clamp die to form a bend having controlled-wrinkles on the inside surface of said tube at said bend, said tube being bent without a ball mandrel inside of said tube;

directing hot combustion gases through said tube wherein turbulence of said combustion gases is increased by flowing over said controlled wrinkles on said inside surface of said tube at said bend; and providing a flow of air across the outside of said tube to heat said air.

11. The method recited in claim 10 further comprising the steps of forming a plurality of said bends in said tube.

12. The method recited in claim 11 wherein each of said bends is formed to be approximately 180°.

* * * * *